United States Patent [19]

Wilson

[11] 4,068,778

[45] Jan. 17, 1978

[54] VOID CAP

[76] Inventor: William Wilson, 716 Scott St., Stroudsburg, Pa. 18360

[21] Appl. No.: 665,976

[22] Filed: Mar. 11, 1976

[51] Int. Cl.[2] ..... B65D 7/42

[52] U.S. Cl. ..... 220/66; 222/566; 366/184; 366/347

[58] Field of Search ..... 220/4 A, 66; 222/196, 222/196.1–196.5, 198, 566; 141/331, 332, 333, 337, 338, 339; 259/29, 36, 125

[56] References Cited

U.S. PATENT DOCUMENTS

| | | | |
|---|---|---|---|
| 216,530 | 6/1879 | Pfitzenmeier | 141/331 X |
| 408,126 | 7/1889 | Mitchum | 259/125 |
| 636,370 | 11/1899 | Wetmore | 222/196 X |
| 797,225 | 8/1905 | Reed | 259/125 |
| 1,190,612 | 7/1916 | Weil | 222/566 X |
| 1,975,265 | 10/1934 | Fulenwider | 220/66 |
| 2,008,564 | 7/1935 | Schumacher | 222/566 X |
| 2,682,970 | 7/1954 | Brothers, Jr. | 220/66 X |
| 3,211,195 | 10/1965 | Porter | 141/331 X |
| 3,750,722 | 8/1973 | Nowak | 141/333 X |

FOREIGN PATENT DOCUMENTS

| | | | |
|---|---|---|---|
| 571,354 | 10/1958 | Belgium | 220/66 |
| 1,119,542 | 6/1956 | France | 220/66 |
| 1,036,213 | 8/1958 | Germany | 220/66 |
| 178,140 | 2/1962 | Sweden | 141/331 |

*Primary Examiner*—Stephen Marcus
*Attorney, Agent, or Firm*—Stuart E. Beck

[57] ABSTRACT

A void cap having a stepped configuration converging to a discharge end enhances blending action by disrupting the sliding action of the materials as they pass along the void cap. Sloped angles at each of the stepped configurations facilitate discharge of material. The void cap is particularly adapted for attachment to one or both ends of steel or fiberboard drum containers thereby changing the total volume of such containers to facilitate addition of materials and/or blending of materials.

10 Claims, 5 Drawing Figures

VOID CAP

FIELD OF THE INVENTION

The present invention relates to void caps and, more particularly, the present invention relates to void caps having a stepped configuration which disrupts the flow of material sliding along the void cap and promotes complete discharge.

BACKGROUND OF THE INVENTION

The art of mixing is highly empirical and to date there has not been developed any formula or equation which can be used to calculate the degree or speed of mixing under a given set of conditions. The fundamental objective to be accomplished by mixing remains essentially the same, namely to achieve uniformity by having each particle of any one material lie as nearly adjacent as possible to a particle of each of the other materials within a given container.

For at least two types of blending operations it would be advantageous to employ a void cap. A void cap can be applied to a container in order to obtain additional space for blending to occur. This is particularly true where containers are shipped essentially full of material leaving little if any space available for blending. Unless a void cap is used it is necessary either to transfer the material to a larger container or to remove a substantial fraction of material before blending can occur. Another instance in which it would be advantageous to employ a void cap is when it is necessary to increase the area of a container for the purpose of adding an additional ingredient or material to material already in the container.

In the past, cones have been attached to ends of containers, such as conventional fiberboard drum containers, 55 gallon drums and other similar types of containers, in order to aid in discharging such containers. One problem associated with the use of cones has been their lack of strength unless made of very heavy material and when they were made of heavy material such as stainless steel their weight and opaqueness were problems. There was also no convenient way to attach the cones to the containers. Moreover, solid particles as well as liquids tended to slide along the cone walls without intermixing. In order to overcome the latter problem, baffles have sometimes been inserted inside the cones. These baffles, however, hinder and sometimes prevent the complete discharge of material from the cone. In addition, the baffles were difficult to clean. These latter factors have tended to limit utilization of cones to the handling of the same type of material in order to avoid contamination problems. Another recognized problem with cones has been the fact that in order to achieve a void space of about 40 percent a given cone must extend a substantial distance from the container making the overall assembly of cone and container unwieldly.

SUMMARY OF THE INVENTION

An object of the present invention is to provide an improved void cap which significantly reduces blending time.

Another object of the present invention is to provide a void cap which causes a disruption of the flow pattern of the material and prevents the sliding of material along the walls of the void cap.

Still another object of the present invention is to provide a void cap which eliminates the separation or stratification of materials that possess poor flow characteristics, such as solid particles having varying densities, sizes, weights and shapes.

Yet another object of the present invention is to provide a void cap having a stepped configuration which has inherent strength while lacking significant weight and which reduces the height of the void cap required to obtain a given percentage of void space.

A further object of the present invention is to provide a void cap which has a stepped configuration which promotes discharge of materials.

A still further object of the present invention is to provide a void cap which can be readily cleaned.

In accordance with the present invention an improved void cap is disclosed having a stepped configuration which disrupts the sliding action of materials along the wall surface and promotes complete and thorough discharge of material. The stepped configuration of the void cap converges to a discharge end and causes material to change directions inside the void cap while moving across the void cap thereby intermixing material. Each stepped configuration of the void cap forms an angle which promotes the complete discharge of materials, promotes improved blending and reduces the required residence time.

BRIEF DESCRIPTION OF THE DRAWINGS

Other and further objects, advantages and features will be apparent to those skilled in the art from the following detailed description thereof, taken in conjunction with the accompanying drawings in which.

DESCRIPTION OF THE PREFERRED EMBODIMENTS

Figure 1:
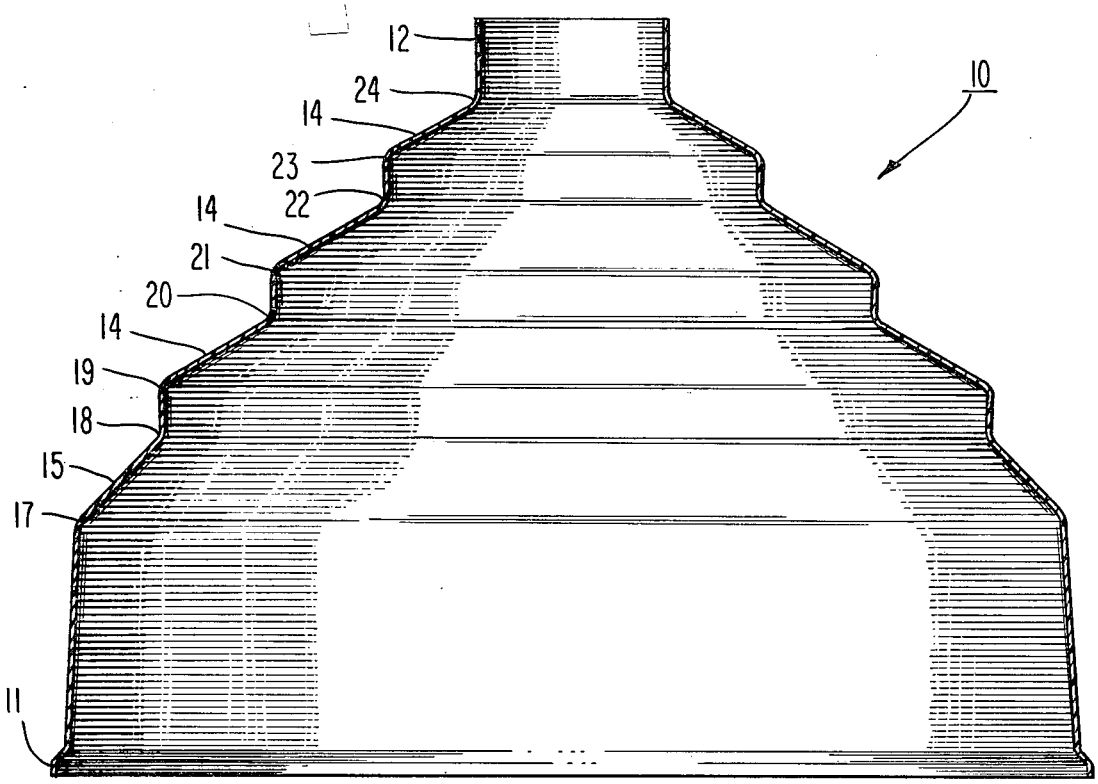
FIG. 1 is a side view in cross section of a void cap in accordance with the present invention.

Referring now to the drawings, an improved void cap in accordance with the present invention is illustrated in FIG. 1. Void cap 10 is generally conical in shape having a large end 11 adapted for attachment to one end of a container, such a fiberboard drum container, a 55 gallon drum, etc. The smaller end 12 of void cap 10 can be fitted with a cover or a suitable valve for discharge of material. In a preferred form void cap 10 has a rigid unitary construction. The inner surface of the cap includes angled side walls 14, 15 separated by annular side walls 16. The width of the angled side walls is greater than the width of the annular side walls. The angled side walls of each step in the stepped configuration of the void cap define an acute angle relative to an axis which is parallel to the axis of the larger end of the void cap, as determined from the smaller end 12 and the annular side walls 16 are annular relative to that same axis. In the embodiment illustrated in FIG. 1 side wall steps 14—14 are at an angle of 60° with the vertical whereas side wall step 15 is at an angle of 45° with the vertical. The corners 17 through 24, inclusive, formed by the juncture of the angled wall portions and the annular wall portions are all rounded. The stepped configuration and rounded corners cause disruption of the flow of materials along the walls of the void cap thereby causing intermingling of materials and eliminating separation or stratification of materials that possess poor flow characteristics, such as solids of varying densities, sizes, weights, or shapes, etc. Because of its configuration a desired 35 or 40 % void space or increased in total volume can be achieved without extending the apex of the void cap as far as would normally be required with a cone having straight side walls. In addition, the stepped configuration of the void cap together with the rounded corners facilitates the complete and rapid discharge of material from small end 12 of void cap 10 and thereby minimizes, if not totally eliminates, the necessity for cleaning the void cap following utilization. The particular configuration of the void cap overcomes the classification problem which frequently occurs with solids sliding down a straight wall of prior art cones and which tended to counteract the blending which has been achieved before discharge.

Figure 2:
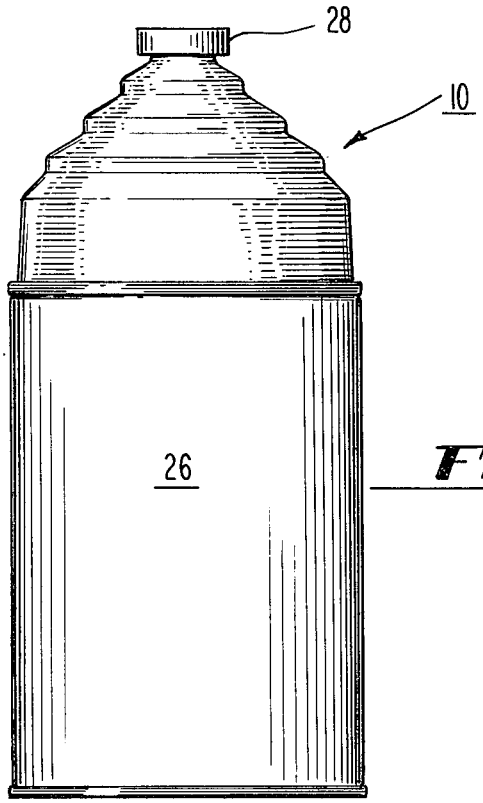
FIG. 2 is a side view of a void cap in accordance with the present invention shown attached to one end of a fiberboard drum container.

In practice the void cap, such as void cap 10 in FIG. 1, would be attached to a container in a manner as illustrated in FIG. 2. FIG. 2 shows conical void cap 10 attached to one end of fiberboard drum container 26. By attaching void cap 10 to container 26 and then using suitable means, not shown, for rotating the container it is possible to obtain fast and intimate blending. This permits compacted or settled material which substantially occupies the space of container 26 to be decompacted upon receipt at a given plant by simply attaching void cap 10 to the container and rotating the container and void cap until the material has become redistributed and properly decompacted. For discharge cap 28 on void cap 10 can be removed and decompacted material can be conveniently discharged from container 26. The design of the void cap permits both liquid and solid materials to be either added to or discharged from container 26. Moreover, the stepped configuration eliminates disadvantages of prior art internal baffles which often hindered the discharge of material from a given container.

In some instances it is desirable to add materials to materials already present in a container. When a container is essentially full such addition is difficult to accomplish and even if possible the result achieved tends to result in the stratification of material. In accordance with the present invention cap 28 of void cap 10 can be removed and additives can then be inserted through the open end of the void cap. In a preferred embodiment of the invention in which the void cap is made of clear plastic material one can see the level of material being added. By replacing cap 28 the additives can then be mixed by suitable rotation or agitation of container 26 with void cap 10.

Figure 3:
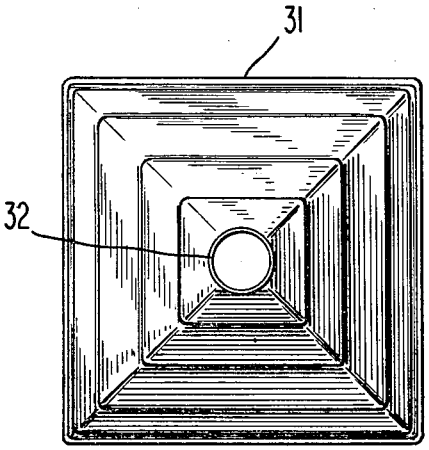
FIG. 3 is a top view of another embodiment of a void cap in accordance with the present invention.

In FIG. 3, the illustrated void cap is designed for attachment to a square or rectangular shaped container. Void cap 30 has a suitable rectangular or square base, for attachment to such a container, and a generally conical configuration including annular wall portions and angled wall portions stepped down to a smaller discharge end 32. Obviously, the conical shaped void caps of the present invention can be adapted for attachment to a variety of different container configurations.

Figure 4:
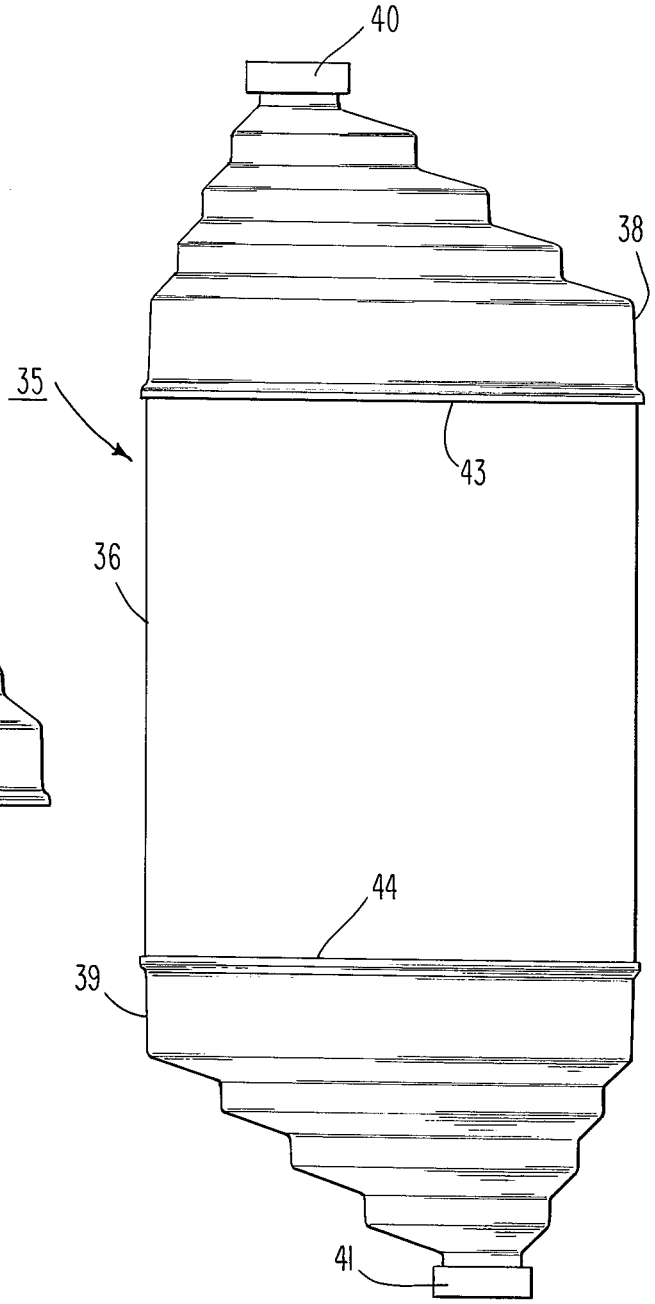
FIG. 4 is a side view of a container having void caps attached to each end, each void cap having a nonsymmetric configuration.

FIG. 4 shows an assembly 35 of a container 36 with nonsymmetrical void caps 38 and 39 attached to opposite ends of container 36. Void caps 38 and 39 have identical configurations but are turned such that at least one of the smaller ends supporting discharge caps 40 and 41 is laterally displaced from an axis which is parallel to an axis passing through the larger end of each of the void caps and which passes through the smaller end of the other void cap. Also the smaller ends can be displaced to opposite sides of the axis passing through the larger ends of the void caps, (or only one smaller end can be displaced from that axis.) The use of two void caps not only doubles the working capacity created by one void cap, but the transverse arrangement illustrated in FIG. 4 provides additional blending action by promoting cross flow of material as container 36 is turned end over end by means not shown. Ends 43 and 44 of void caps 38 and 39, respectively, are adapted to become engaged with the ends of container 36 by a simple friction fit. As an additional precaution suitable means such as a band can be applied around ends 43 and 44 to retain the void caps in position.

Figure 5:
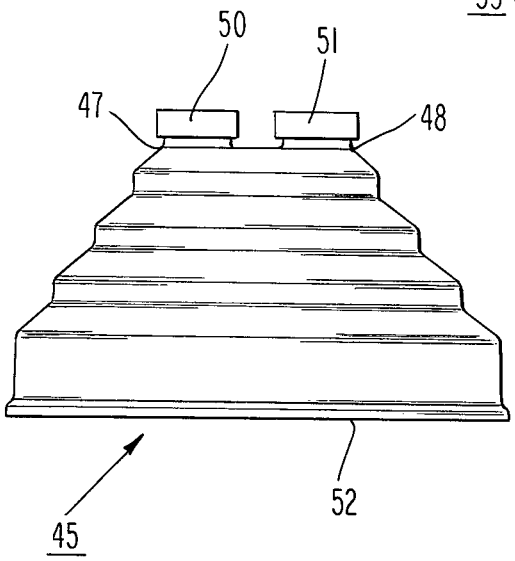
FIG. 5 is a side view of another void cap embodiment of the present invention which has dual discharge ports.

In FIG. 5 void cap 45 has two discharge ports 47 and 48 with caps 50 and 51, respectively, opposite larger end 52 and laterally displaced from the axis passing through the larger end. This embodiment permits discharge of material from a container (not shown) into conventional tablet pressing equipment (not shown). In addition, this configuration tends to minimize product separation during discharge.

Plastic material, such as Lexan, polypropylene, polystyrene and other suitable materials, can be molded into the different shapes needed for containers of varying configurations. Vacuum forming techniques are particularly advantageous. It will be understood that other materials, including metal and fiberglass can be utilized to form void caps of the present invention. Materials which permit molding, however, are naturally preferred because they totally eliminate the requirement for seams or fasteners in the construction of the void cap. Generally the moldable plastic materials also have the advantage of being lighter in weight.

One advantage of the stepped configuration of the void cap is the fact that this configuration adds significantly to the overall strength of the void cap and permits the utilization of lighter weight materials than would otherwise be possible if the conical portion of the void cap was formed with straight walls. This weight advantage permits fairly large void caps to be easily handled by one man. Nevertheless, void caps of the present invention can be utilized with exterior reinforcement if additional strength is needed in connection with fairly large applications.

From the foregoing, it will be seen that this invention is well adapted to attain all of the ends and objects hereinabove set forth, together with other advantages which are obvious and inherent. An improved void cap is provided having inherent strength and improved mixing efficiency. It will be understood that the void caps can, if desired, be attached to both ends of a container in order to double the total void space and provide more rapid blending action. By accomplishing mixing in a shipping container problems associated with transfer of the shipped material to a mixing container are avoided. This fact together with the small size of the discharge end of the void cap aid in controlling discharge flow rates and dust problems. It will be understood that angles other than those of the preferred embodiments can be utilized provided the angles are sufficiently steep to prevent retention of material upon discharge from the void cap. The number of stepped configurations in the side wall of the void cap is obviously variable. Four or five such stepped configurations are normally preferred, but this can be varied to have either a greater or lesser number. The stepped configuration prevents material from sliding by interrupting or changing of the flow of material thereby enhances the blending action. Material traveling down the stepped sidewall of the void cap is actually thrown into the interior of the void cap or back into the container. For some applications the void caps will be used solely for blending or decompaction and it will not be necessary to have a discharge opening in the void caps. For other applications it can be advantageous to have discharge opening which is off center or have multiple discharge openings. The void cap can also be constructed to have internal converging channels.

Obviously, many modifications and variations of the invention as hereinbefore set forth can be made without departing from the spirit and scope thereof and therefore only such limitations should be imposed as are indicated by the appended claims.

What is claimed is:

1. A void device for a container, said cap having a rigid generally conical shape and having an opening at each end, the larger end of said cap being of sufficient size to be coupled to an open end of a container that contains material and the smaller end being for discharge of the material, said larger end including an axis, the inner surface of the side walls of said cap being comprised of a plurality of side wall portions that are parallel to said axis and a plurality of angular side wall portions, some of said angular side wall portions being disposed at an angle of about 45° relative to said axis, some of said side wall portions being disposed at an angle of about 60° relative to said axis, said angular portions being disposed between said annular portions with said portions angled at 60° being further from said large end than said portions angled at 45° and the juncture of said wall portions is rounded so that said angled side wall portions and said parallel side wall portions cooperate with each other and with said rounded junctures to disrupt the flow of material and cause it to change direction thereby intermixing it as it is discharged from the container through said void cap.

2. The void cap device of claim 1 wherein the parallel wall portions closest to said larger end are wider than said angled wall portions so that when said void cap is inverted, material moving along said side walls first encounters said parallel wall portions which enable its speed there along to increase substantially before it encounters said adjacent angled wall portions and its direction of flow is changed to thereby enhance the mixing of material.

3. The void cap device of claim 2 including a container, means on the larger end of said cap for engaging said container, and the volume of said cap is about 35 % to 40 % of the volume of said container so that rotation of said container will cause material therein to move into said void cap and be mixed thereby.

4. A void cap device as defined in claim 1 including a second void cap, said second void cap having substantially the same arrangement as said first void cap, a means for containing material to be mixed, the larger end of each of said caps being coupled to the opposite ends of said containing means, an axis defined by the larger end of each of said caps, and said axis passes through the smaller end of each of said caps.

5. The void cap device of claim 1 wherein said void cap is comprised of clear material.

6. The void cap device of claim 1 wherein said smaller end is displaced laterally from said axis.

7. The void cap device of claim 1 including a second smaller end laterally displaced from said first smaller end.

8. A void cap device comprising a means for containing material to be mixed and first and second void caps, said void caps each having a generally conical shape and being open at each end, the larger end of said caps being coupled to the opposite ends of said containing means and the smaller ends being adapted to discharge material when not closed, the inner surfaces of the side walls of said cap being comprised of a plurality of side wall portions that are parallel to the axis of the larger end of said cap and a plurality of side wall portions that are disposed at an acute angle relative to said axis and at least one of said smaller ends is laterally displaced from said axis.

9. The void cap device of claim 8 wherein both of said smaller ends are laterally displaced from said axis.

10. The void cap device as defined in claim 8 wherein said smaller ends are on opposite sides of said axis.

* * * * *

UNITED STATES PATENT OFFICE

CERTIFICATE OF CORRECTION

Patent No. 4,068,778 Dated January 17, 1978

Inventor(s) William Wilson

It is certified that error appears in the above-identified patent and that said Letters Patent are hereby corrected as shown below:

Claim 1, line 1; after "void" insert --cap--.

Add claim 11 as follows:

-- 11. The void cap device of claim 7 wherein each of said smaller ends is displaced laterally of said second axis.--

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*